US005863140A

United States Patent [19]

DeMarchi

[11] Patent Number: 5,863,140

[45] Date of Patent: Jan. 26, 1999

[54] PRINTER PLATEN ASSEMBLY FOR A HANDHELD PRINTER

[75] Inventor: Michael E. DeMarchi, Germantown, Tenn.

[73] Assignee: Thomas & Betts Corporation, Memphis, Tenn.

[21] Appl. No.: 772,216

[22] Filed: Dec. 19, 1996

[51] Int. Cl.[6] ..... B41J 11/20

[52] U.S. Cl. ..... 400/648; 400/56; 400/23

[58] Field of Search ..... 400/55, 56, 57, 400/23, 648, 649

[56] References Cited

U.S. PATENT DOCUMENTS

| | | | |
|---|---|---|---|
| 2,045,618 | 6/1936 | Sherman et al. | 400/649 |
| 2,846,044 | 8/1958 | Stimson et al. | 400/649 |
| 3,242,859 | 3/1966 | Avgerinos et al. | 101/269 |
| 3,463,084 | 8/1969 | Nineberg | 101/279 |
| 3,601,047 | 8/1971 | Waibel | 101/316 |
| 4,120,245 | 10/1978 | Karp et al. | 400/55 |
| 4,144,810 | 3/1979 | Sato | 101/292 |
| 4,201,133 | 5/1980 | Sato | 101/288 |
| 4,206,703 | 6/1980 | Sato | 101/291 |
| 4,582,984 | 4/1986 | Peterpaul et al. | 235/58 CF |
| 4,735,351 | 4/1988 | Biswas | 225/25 |
| 4,843,338 | 6/1989 | Rasmussen et al. | 347/8 |
| 5,372,443 | 12/1994 | Borucki, Jr. et al. | 400/649 |

OTHER PUBLICATIONS

Brady LS2000 Labeling System, Chapter 1, "Quick Start Guide" and Appendices.

*Primary Examiner*—Edgar S. Burr
*Assistant Examiner*—Leslie Grohusky
*Attorney, Agent, or Firm*—Hoffmann & Baron, LLP

[57] ABSTRACT

A self-adjusting printing assembly for accommodating generally planar media of differing thickness comprising a printing head for placement of indicia on said media, a guide assembly positioned adjacent said printing head for guiding said media to said printing head. The guide assembly includes a planar platen for continuously supporting one surface of said planar media and a planar shield member fixedly supported with respect to said platen for continuously supporting said surface of said planar media. The assembly also includes means for movably mounting said platen with respect to said shield for movement in a direction toward and away from said planar shield while maintaining said planar platen generally parallel to said shield for accommodating said media of differing thickness, and a drive means for urging said media through said guide assembly and towards said printing head.

10 Claims, 5 Drawing Sheets

PRINTER PLATEN ASSEMBLY FOR A HANDHELD PRINTER

FIELD OF THE INVENTION

The present invention relates to the field of handheld printing devices. More specifically the present invention relates to a printer platen assembly for use in a handheld printing device that accommodates print media of different thicknesses.

BACKGROUND OF THE INVENTION

Handheld printing devices are commonly employed for printing indicia such as price tags, electrical wire markers, and the like. Such devices print indicia on various types of available media. Regardless of the type of media employed, it is necessary that the printed indicia be clearly marked on the media so that the information thereon may be clearly conveyed. The typical printing devices include printing heads that may be either manually or electronically set to print the desired indicia on the media.

Printing devices must provide labels that are legibly printed. Of significant concern is that the printing device provide printed labels in a consistent and predictable manner to the printing plane of the printing head. In that regard the printer must steadily support the printing surface of the media in the printing plane so that the marking applied by the printing head thereon is legible. In order to support the media during printing, a platen of some type is employed. The platen typically includes either a portion of a flat plate or a rolling cylinder against which a print head strikes to print indicia on a label held against the platen.

It is well known that in printing labels for wire marking purposes it may be desirable to print the indicia on various types of media. Such media may include paper or film labels or, in the case of wire markers, polymer tubes. Thus the media thickness will vary, depending on the type of label and the application. The position of the printing surface of the media must be precisely maintained in the printing plane as the printing head applies ink to the media. The thickness of the label can affect the printing performance since, for a given printing plane, the relative position between the platen and the printing surface of the print media will vary with the thickness of the media. For example, in order to precisely locate the printing surface of a print media with respect to the printing plane of a printing head, thicker print media requires that the platen be located further from the printing plane and thinner print media requires that the platen be located closer to the printing plane. The platen and the printing head may therefore need to be relatively adjustable so as to accommodate print media of varying thicknesses.

Relative movement between the platen and the printing head is shown in the prior art labeling devices.

U.S. Pat. No. 3,463,084, to Nineberg, shows a planar platen on which print media is stacked in a staggered fashion thereon. The exposed margins of each layer of stacked media passes beneath a rotary printing cylinder. The platen is mounted on springs so that as each successive layer of the stacked media comes under the rotary cylinder, the cylinder drives the stack, and thereby the platen, downward so that the printing plate of the rotary cylinder engages each exposed margin. The platen of the '084 patent is employed in a large non-portable machine.

U.S. Pat. No. 4,144,810, to Sato, shows a planar platen as part of a handheld printing machine with opposing spring assemblies for urging a print media on the platen to briefly engage a printing device. The platen is continuously biased against the printing device and a restraining means blocks motion of the platen toward confrontation with the printing device. Not until the operator squeezes a hand lever will the platen be free to momentarily urge the print media into the printing plane of the printing device. The '810 patent, however, does not provide for accommodating print media of varying thicknesses in the printing plane of the printing head.

U.S. Pat. No. 4,206,703, to Sato, shows a handheld label printing machine with a pivotably movable planar platen that pivotally raises the print media to the printing head when hand levers are pressed together. When the operator relaxes the grip, the platen is pivotally lowered from the printing head. The '703 patent likewise fails to provide for accommodation of print media of varying thicknesses in the printing plane of the printing head.

U.S. Pat. No. 4,843,338, to Rasmussen, shows a plate-type platen which is biased by compression springs, so as to be urged farther away from the printer when thicker media is fed between the platen and the printhead. This platen assembly is held stationary at one end and is movable against a spring assembly at the other end. The platen thus pivots to accommodate thicker print media such that the platen is at an angle with the printing plane. Furthermore the platen is curved inflectivey to the curvature of the delivery mechanism so that the platen imparts a reversed bow in the print media with respect to the delivery mechanism. However, as the platen of this device pivots, it changes the alignment between the printing surface of the print media and the printing plane. Changing the thickness of the print media may result in a certain degree of misalignment. Furthermore, the '338 patent does not disclose a handheld printing device as it is directed to a large stationary printing device.

U.S. Pat. No. 5,372,443, to Borucki, shows a printer assembly with a pivotable platen having a curved portion at an end that urges the print media against a stationary mask. At the opposite end from the curved portion, a torsion spring wound around the pivoting axis of the platen urges the curved portion of the platen against the stationary mask. The guidepath delivering the print media to the platen-mask includes opposing rollers. The roller on the platen side of the print media is fixed while the opposing rollers are spring biased. The '443 patent provides another example of a platen that pivots and therefore is unable to maintain the alignment between the printing surface of the print media and the printing plane of the printing head for print media of various thicknesses. While the device shown in the '443 patent is designed to accept such media, the device includes complex mechanical components which rely on precise pivotal movement to adjust for variations in media thickness.

It is therefore desirable to provide a hand held printing device which will accommodate print media of varying thicknesses and maintain the alignment between the printing surface of the print media and the printing plane of the printing head and which is less complicated and more reliable than the prior art devices.

SUMMARY OF THE INVENTION

It is an object of the present invention to provide a printer platen assembly for a handheld printing device that ensures proper feeding of a print media to the printing plane of the printing device.

It is another object of the present invention to provide a printer platen assembly for a handheld printing device that self-adjusts to accommodate print media of varying thicknesses.

It is still another object of the present invention to provide a printer platen assembly for a handheld printing device that continuously urges a print media into the printing plane of the printing device.

Another object of the present invention is to provide a printer platen assembly for a handheld printing device with improved characteristics for holding a print media against a printing head.

In the efficient attainment of these and still other objects, the present invention provides a printer platen assembly capable of accommodating print media of differing thicknesses. The present invention further maintains the alignment between the printing surface of the print media and the printing head of a printing device. The printer platen assembly includes a printing head for printing indicia on the print media and a guide assembly for guiding the print media to the printing head. The guide assembly includes a planar printer platen, a fixed planar shield opposing the planar platen, means for mounting the planar platen to move in a direction toward and away from the planar shield. The mounting means maintain the planar platen generally parallel to the planar shield for accommodating print media of differing thicknesses therebetween. The guide assembly also includes means for urging the print media through the guide assembly towards the printing head.

DETAILED DESCRIPTION OF THE INVENTION

Figure 1:
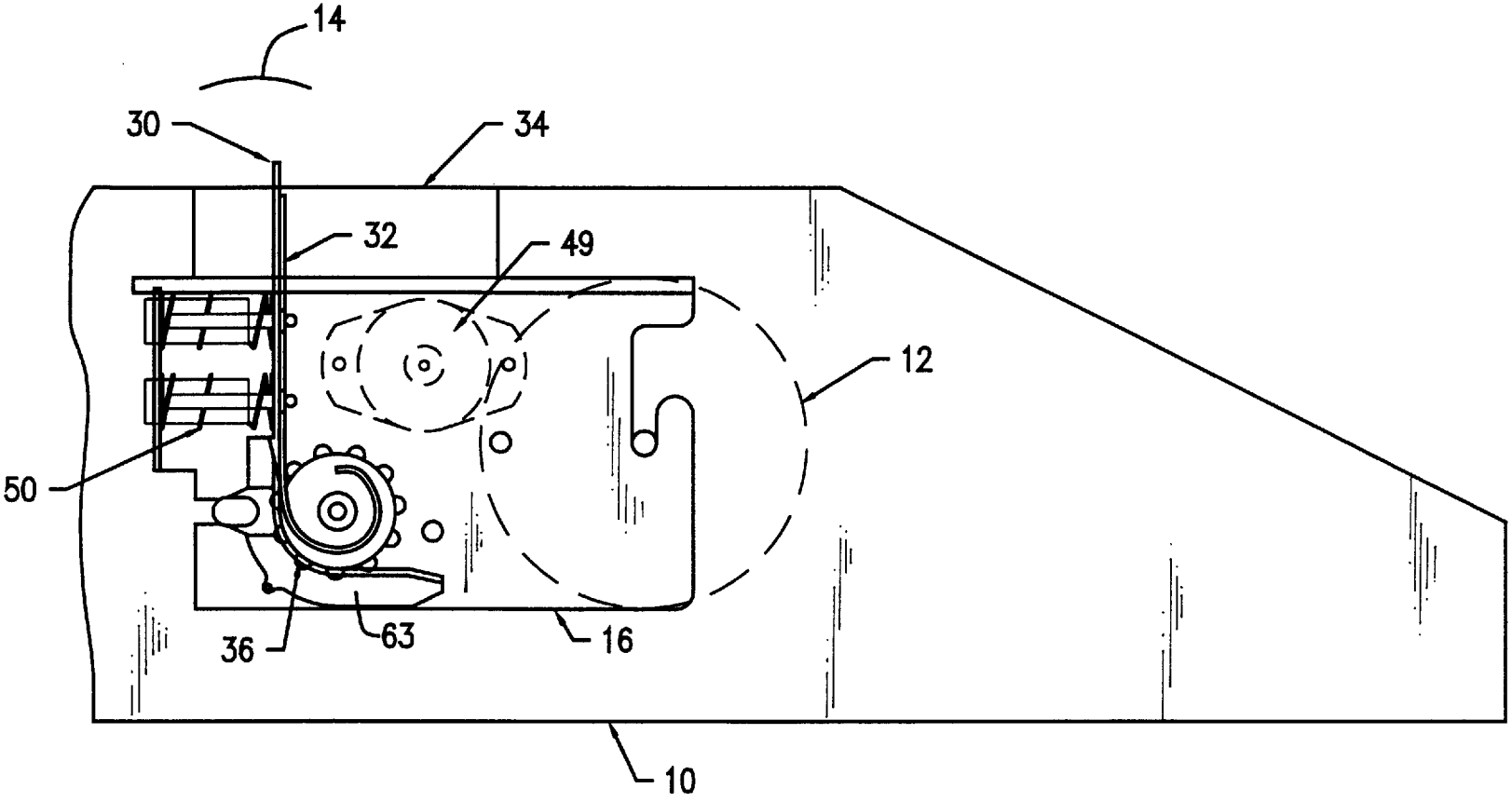
FIG. 1 is a schematic showing a side view of printer and housing containing the printer platen assembly of the present invention.
Figure 2:
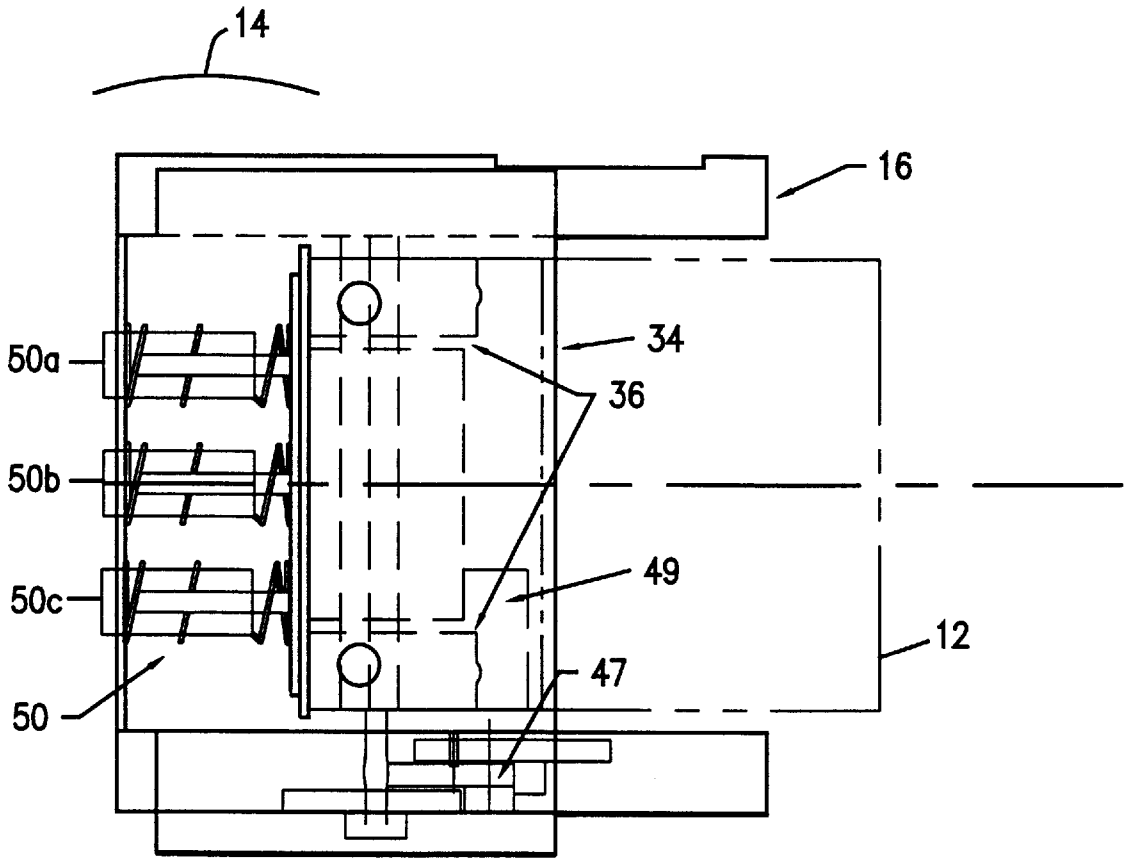
FIG. 2 is a schematic showing a top view of the housing containing the printer platen assembly of the present invention.

Referring to FIGS. 1 and 2, the present invention provides a handheld printer 10 for printing indicia on a variety of print media 12. The present invention includes a self-adjusting printer platen assembly 14 supported in a housing 16. Housing 16 is shown schematically and may be any printer housing capable of supporting platen assembly 14 therein. In the present preferred embodiment, housing 16 is part of portable handheld printing device 10. Printing device 10 is used to place printed indicia on a supply of print media 12. As is known in the art, printing device 10 generally includes a housing having a keypad or other mechanism for selecting the output from a printing head 34, a replaceable supply of print media 12, and a printer platen assembly 14 for delivering the print media to, and maintaining the print media 12 in, the printing plane of the printing head 34.

Figure 4:
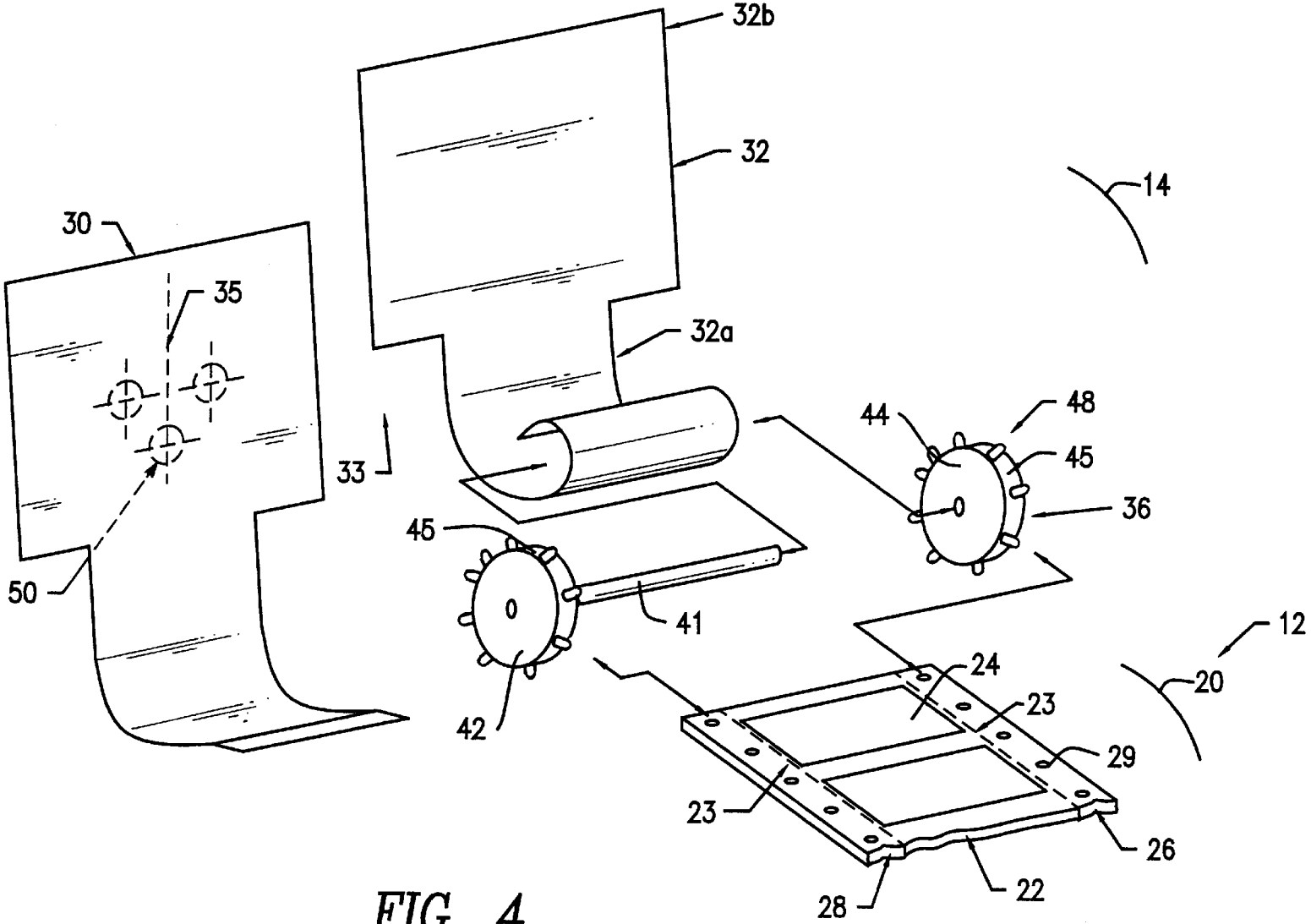
FIG. 4 shows an exploded isometric view of the printer platen assembly of the present invention.

The print media 12 employed in combination with the presently described preferred embodiment of the present invention may be of a variety of the types commonly used in marking electrical wires or cables. Such media 12 may include paper or plastic labels as well as tubes which may be placed over wire. As shown in FIG. 4, the print media 12 will have certain general characteristics. Print media 12 includes an elongate generally planar body 20 having a central location 22 which supports a plurality of wire markers 24 in longitudinal succession. Body 20 includes on opposed lateral sides a pair of longitudinally extending guide strips 26 and 28 which are removably attached to central location 22 by perforations 23. Guide strips 26 and 28 include a series of spaced apart apertures 29 therethrough which are used to guide planar body 20 through platen assembly 14 as will be described in detail hereinbelow. As mentioned above, wire markers 24 supported on body 20 may be a series of joined marker segments separated by perforations or may individually attach discrete markers.

Figure 3:
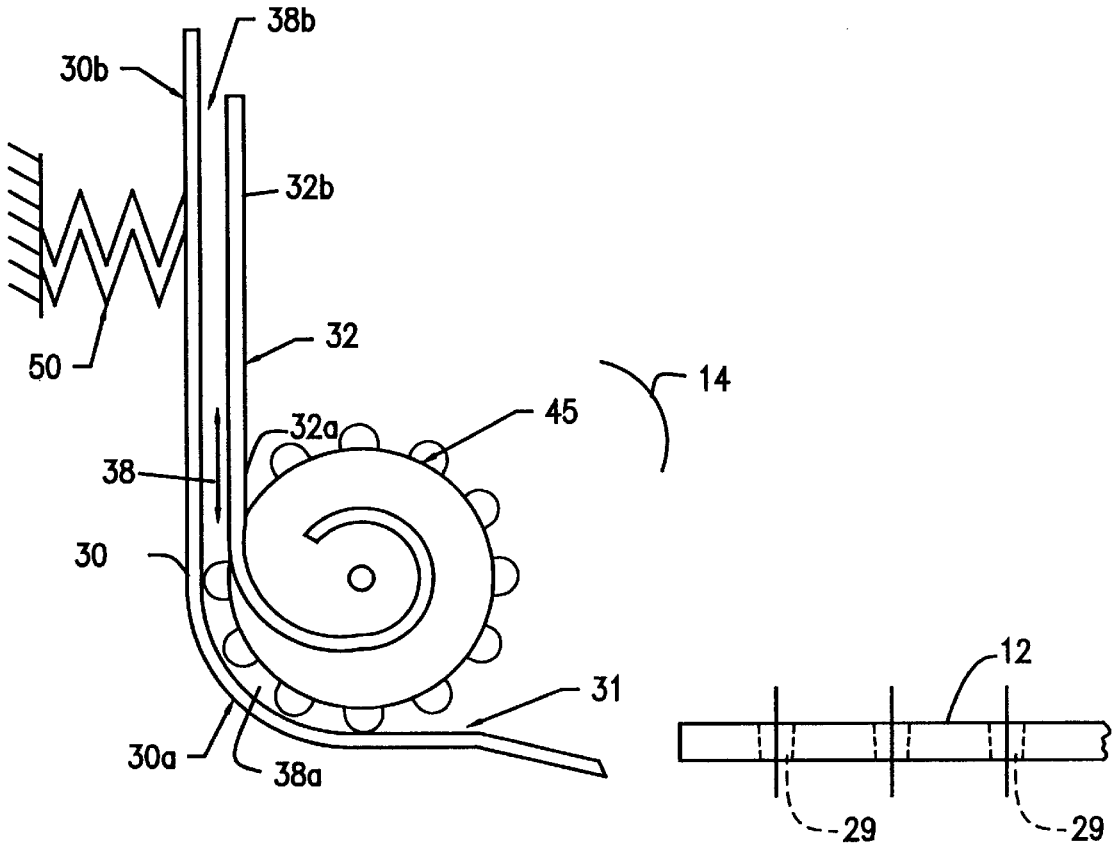
FIG. 3 shows the guidepath as formed by the platen, the shield and the sprockets according to the present invention.

As shown in FIGS. 1, 3 and 4, platen assembly 14 includes an elongate generally planar platen 30 and an elongate generally planar ribbon shield 32 which is aligned with platen 30. A printing head 34, which is used to print indicia on the wire markers 24 of media 12, is positioned adjacent one end 32*b* of ribbon shield 32. Platen assembly 14 further includes a sprocket drive mechanism 36 adjacent opposed end 32*a* of ribbon shield 32 which is operable to drive print media 12 through a guidepath 38 defined between platen 30 and ribbon shield 32. The print media 12 is also supported against the sprocket drive wheels 42 by the paper guide 63.

With reference to FIGS. 2 and 3, sprocket drive mechanism 36 includes sprocket wheels 42 and 44 connected by shaft 41. Sprocket wheels 42 and 44 are engaged by drive train 47 which is driven by a motor 49. Wheels 42 and 44 have a circumferential rim surface 45, from which extend a plurality of sprockets 48 radially aligned between sprocket wheels 42 and 44. Sprockets 48 are designed to be inserted into apertures 29 of guide strips 26 and 28 to urge print media 12 through elongate guidepath 38. Curved portion 32*a* of shield 32 spans between sprocket wheels 42 and 44. Notwithstanding the depiction in FIG. 3, curved portion 32*a* of shield 32 may have a larger or smaller radius of curvature than rim surface 45 of the sprocket wheels.

Guidepath 38 through which media 12 transverses includes a curved entry end 38*a* which is defined by opposed curved end extents 30*a* and 32*a* of platen 30 and ribbon shield 32 respectively. Curved end extents 30*a* and 32*a* curve in a mutually diverging manner to provide a "funnel-like" entry 31 for media 12. The curved end 32*a* of ribbon shield 32 includes lateral cutouts 33 to accommodate the sprocket wheels. Guidepath 38 has an opposed elongate egressing end 38*b* which terminates adjacent printing head 34. Egressing end 38*b* of guidepath 38 is generally linear being defined by opposed linear extents 30*b* and 32*b* of platen 30 and ribbon shield 32 respectively.

Figure 5:
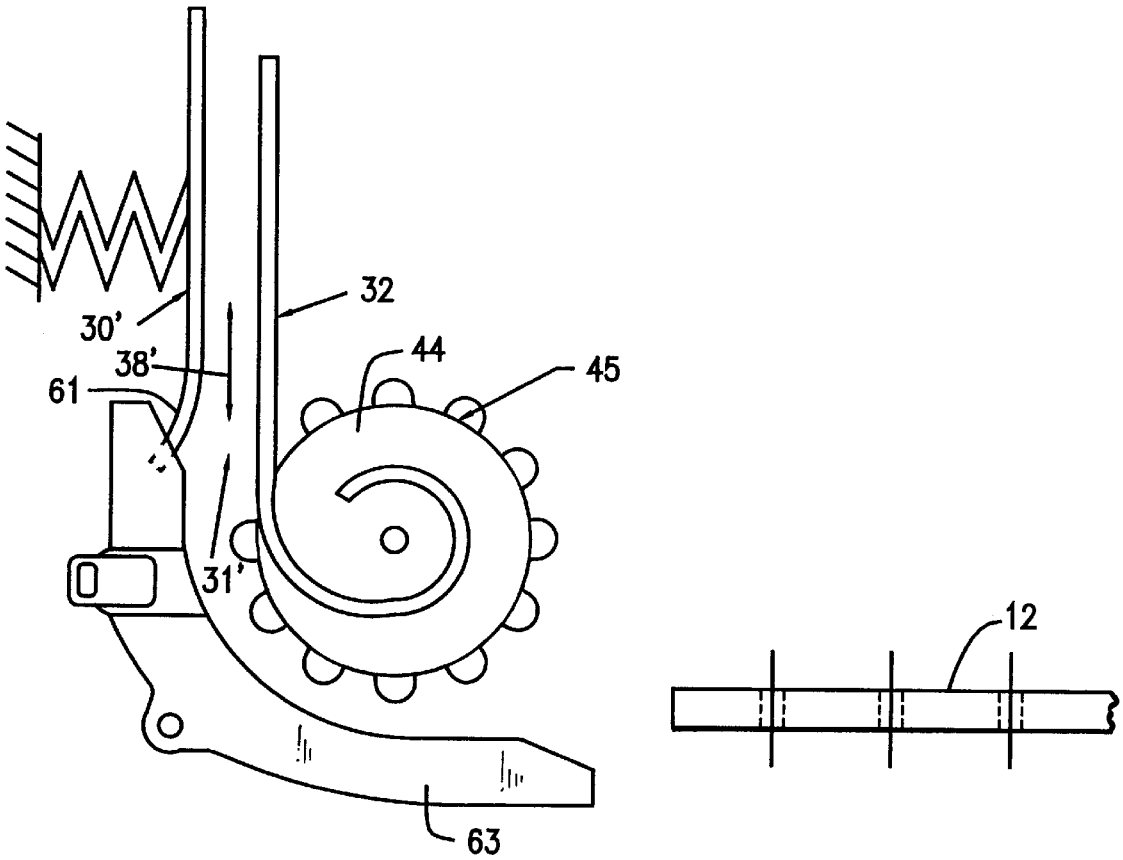
FIG. 5 presents an alternate embodiment of the present invention having a tapered end to the platen adjacent the planar portion of the print shield.

FIG. 5 shows an alternate embodiment of the present invention wherein platen 30' include a tapering entry edge 61 located more proximally to the planar portion of the ribbon shield 32. The guidepath 38' defined between platen 30' and with shield 32 includes funnel entry 31' more proximate to printing head 34. In this embodiment the print media 12 is supported against the sprocket wheels 42 and 44 by the paper guide 63 prior to entry of the print media 12 into guidepath 38'. The truncated platen 30' allows access to the sprocket drive mechanism 36 should it become necessary to clear jammed print media from around the sprocket wheels 42 and 44.

With either embodiment, platen 30 is mounted in housing 16 so as to be moveable with respect to ribbon shield 32. Such movement is provided so as to maintain print media 12 in alignment with printing head 34 as well as to accommodate media of varying thickness. Platen 30 is moveably mounted by a spring assembly 50 in engagement with linear extent 30*b* thereof. Spring assembly 50 provides for movement of platen 30 with respect to ribbon shield 32.

The present invention provides for parallel movement of the platen 30 with respect to ribbon shield 32. Spring assembly 50 permits movement of platen 30 adjacent the bias of spring assembly 50 and returns platen 30 into engagement with ribbon shield 32 with the bias of spring assembly 50.

Referring to FIGS. 1 through 4, substantial parallel movement of platen 30 is provided by spring assembly 50 including a plurality of springs spaced longitudinally and transversely against linear extent 30*b* of platen 10. Preferably, spring assembly 50 includes three springs 50*a*, 50*b* and 50*c* spaced in a 2-1 fashion that is symmetrical about a longitudinal center line 35' of guidepath 38, as shown in FIG. 4, to better maintain the parallel alignment between platen 30 and ribbon shield 32.

Prior to print media 12 entering the guidepath 38 of the printer platen assembly 14, spring assembly 50 urges platen 30 against ribbon shield 32, effectively closing guidepath 38. However, due to the configuration of opposed curved end extents 30*a* and 32*a*, the funnel entry end 38*a* allows insertion of media 12 thereinto. Print media 12 is fed into the funnel entry 38*a* of guidepath 38 by operation of sprocket drive mechanism 36.

As print media 12 enters the funnel entry 38*a*, it will reach a point in guidepath 38 where platen 30 is against ribbon shield 32. Upon reaching this point in guidepath 38, sprocket drive mechanism 36 will continue to urge the print media between the platen 30 and shield 32. Such continued movement of the print media will cause platen 30 to be urged against the bias of spring assembly 50 and away from the ribbon shield 32 to allow print media 12 to continue through guidepath 38. The movement of platen 30 with respect to ribbon shield 32 is parallel thereto so as to maintain proper alignment of media 12 with ribbon shield 32 and printing head 34. As it traverses through guidepath 38, print media 12 will be positioned so that the central location 22 is exposed to the printing head 34. The wire marker 24 will therefore be in a position to be marked with the desired indicia by printing head 34.

The present invention is not limited to a printer platen assembly having a sprocket wheel for urging the print media of varying thickness through the guidepath. Other methods for urging the print media through the guidepath are within the contemplation of the present invention. For example, the wheels could have a rim surface with a high coefficient of friction the platen would then not have notches cut-out therefrom. The wheels could thus urge the print media through the guidepath with sufficient force to displace the platen the necessary distance.

Various other modifications to the foregoing disclosed embodiments will now be evident to those skilled in the art. Thus, the particularly described preferred embodiments are intended to be illustrative and not limited thereto. The true scope of the invention is set forth in the following claims.

What is claimed is:

1. A self-adjusting printing assembly for accommodating generally planar media of differing thickness comprising:

a printing head having a printing plane in which printed indicia may be placed on said media;

a guide assembly positioned adjacent said printing head for guiding said media to said printing plane of said printing head;

said guide assembly including:

a planar platen for continuously supporting one planar surface of said media;

a planar shield member fixedly supported with respect to said printing head for continuously supporting an opposed planar surface of said media;

means for movably mounting said platen with respect to said shield for movement in a direction toward and away from said planar shield so as to maintain said planar platen generally parallel to said planar shield while maintaining said media therebetween in said printing plane of said printing head;

drive means for urging said media through said guide assembly and towards said printing plane of said printing head; and a spring assembly including a plurality of independent springs positioned at spaced locations against said platen so as to be spaced longitudinally and latitudinally with respect to said planar platen, wherein said platen is movable against the bias of said spring assembly.

2. The printing assembly of claim 1 wherein said movement of the platen maintains a substantially fixed alignment between the media and the printing head.

3. The printing assembly of claim 1 wherein the plurality of springs are spaced across from planar shield.

4. The printing assembly of claim 1 further including a paper guide opposed to said drive means, said paper guide urges said media towards said printing head.

5. A self-adjusting printing assembly for accommodating generally planar media of differing thickness comprising:

a printing head having a printing plane in which printed indicia may be placed on said media;

a guide assembly positioned adjacent said printing head for guiding said media to said printing plane of said printing head;

said guide assembly including;

a planar platen for continuously supporting one planar surface of said media:

a planar shield member fixedly supported with respect to said printing head for continuously supporting an opposed planar surface of said media;

means for movably mounting said platen with respect to said shield for movement in a direction toward and away from said planar shield so as to maintain said planar platen generally parallel to said planar shield while maintaining said media therebetween in said printing plane of said printing head; and drive means for urging said media through said guide assembly and towards said printing plane of said printing head, wherein said planar shield further comprises a planar shield portion and a curved shield portion contiguous with said planar shield portion and wherein said drive means further comprises a sprocket assembly substantially coaxial with said curved shield portion.

6. The printing assembly of claim 5 wherein said planar platen further comprises a planar platen portion and a curved platen portion contiguous with said planar platen portion and wherein said sprocket assembly is opposed to said curved platen portion.

7. The printing assembly of claim 6 wherein a portion of said curved platen portion has the same radius of curvature as the wheels of said sprocket assembly.

8. The printing assembly of claim 5 wherein said sprocket assembly further comprises a plurality of wheels.

9. The printing assembly of claim 8 wherein said wheels include a plurality of circumferential sprockets protruding therefrom.

10. The printing assembly of claim 8 wherein said wheels are coaxially disposed on either side of said curved shield portion.

* * * * *